United States Patent [19]

Yon

[11] Patent Number: 4,619,013

[45] Date of Patent: Oct. 28, 1986

[54] WALL CORNER FINISHING TOOL

[76] Inventor: Gary Yon, 8495 Remington Dr., Pittsburgh, Pa. 15237

[21] Appl. No.: 769,163

[22] Filed: Aug. 23, 1985

[51] Int. Cl.[4] ..... B05C 17/10

[52] U.S. Cl. ..... 15/235.8; 425/458

[58] Field of Search ..... 425/458; 15/235.7, 235.8

[56] References Cited

U.S. PATENT DOCUMENTS

| | | | |
|---|---|---|---|
| 109,073 | 11/1970 | Streeter | 15/235.8 |
| 952,971 | 3/1910 | Wolary et al. | 15/235.8 |
| 2,178,899 | 11/1939 | Shaffer | 15/235.7 |
| 2,608,853 | 9/1952 | Schrepper | 15/235.7 |
| 2,616,285 | 11/1952 | Shields | 15/235.7 |
| 3,373,458 | 3/1968 | Haivala | 15/235.8 |

FOREIGN PATENT DOCUMENTS

| | | | |
|---|---|---|---|
| 2226532 | 11/1974 | France | 15/235.7 |

*Primary Examiner*—Willard E. Hoag

*Attorney, Agent, or Firm*—Reed Smith Shaw & McClay

[57] ABSTRACT

A hand finishing tool for dry wall board installation consisting of three operative components: a main body comprising a planar sheet material formed into two substantially flat sides extending radially from the common line to define a dihedral configuration; a manual tool gripping means pinned at its stem end to the inner surface of the main body; and a tool biasing means adapted, upon digital manipulation, to outwardly bias the flat sides to temporarily enlarge the angle that the sides normally define during tool use.

5 Claims, 6 Drawing Figures

WALL CORNER FINISHING TOOL

FIELD OF THE INVENTION

This invention relates to a finishing tool for installers of dry wall boards and providing square corner finishes.

BACKGROUND OF THE INVENTION

Hand tools called plasterer's trowls and plows have long been available for smoothing and shaping wet plaster in the corners defined by the adjacent walls of a room. See U.S. Pat. No. 3,079,622, issued Mar. 5, 1963. Such tools are not successfully adaptable to the more currently used dry wall installation approach. A present need is the provision of a trimming tool which will blend the wet filling plaster and the corner ceiling tapes now employed. Such is needed to finish smoothly the corners of dry constructed building walls formed of rigid but shapable wall board with a minimum of manual labor so as to effect an esthetically pleasing seam as to adjoining wall boards. One approach to this construction need is described in U.S. Pat. No. 2,616,285 to S. T. Shields, issued Nov. 4, 1952.

OBJECT OF THE INVENTION

The principal object of the invention is to provide a finishing tool for wall board installers which can be used with facility to consistently seal and smooth the abutting corners of dry wall board after their installation. A further object is to provide a manually adjustable, dualbladed tool for the prime object stated, which will form substantially accurate taped corners while effecting a feather edged joint between the converging hard panel board surfaces, thus eliminating much of the time spent by the installer in sanding down the plastered seal of the wall corners to gain the esthetic objective of a feather edge with the surfaces of the abutting panels.

SUMMARY OF THE INVENTION

Accordingly, there is provided a hand finishing tool for dry wall board installation consisting of three operative components: a main body comprising a planar sheet material formed into two substantially flat sides juxtaposed to one another and divergent from a common line to define a dihedral configuration, preferably at a uniform set angle, which is measurably greater than 90°; a manual tool gripping means pinned at its stem end to the inner surface of the main body and at its gripping end projecting rearwardly of the back edge of that body; and a tool biasing means operatively anchored to the stem of the gripping means and adapted, upon digital manipulation, to outwardly bias the flat sides to temporarily enlarge the angle that the sides normally define during tool use so as to aid in gaining the smooth surface effect of the sealing material being deposited into the wall board corners.

DETAILED DESCRIPTION OF THE INVENTION

Figure 1:
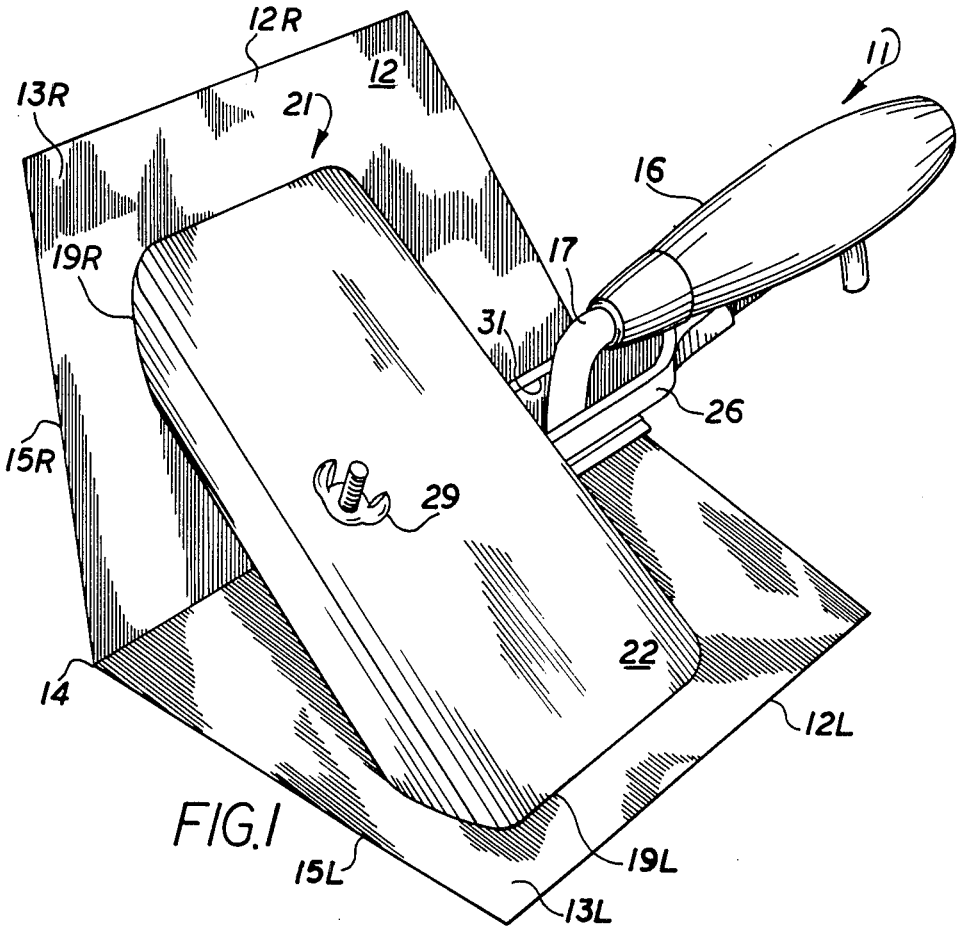
FIG. 1 is a perspective view of the forward end of a tool for the formation of inside corner joints on dry walls.
Figure 2:
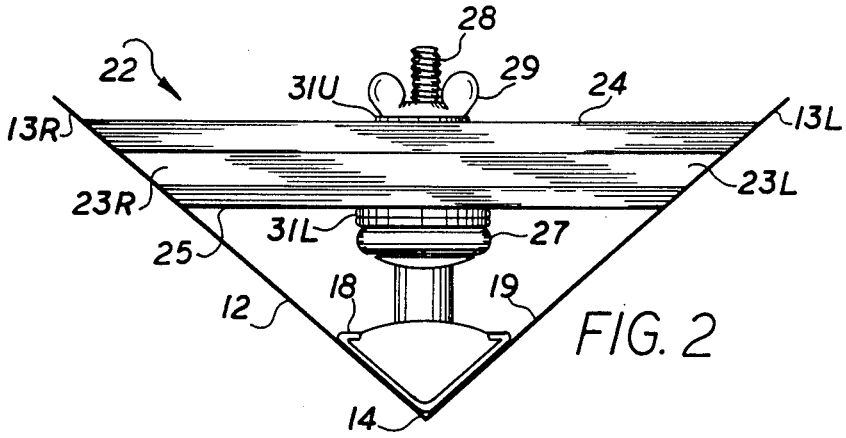
FIG. 2 is a forward end view of the tool shown in FIG. 1.

Referring now to the drawings, and to FIG. 1 in particular, there is shown a perspective view of the tool of the present invention specially adapted for finishing inside corner joints which are formed on dry wall construction. The body of the tool, generally 11, comprises a sheet of flexible metal 12 of about 0.15 to 0.25 inches in thickness. This sheet material has been pre-formed into two substantially flat sides, 13L and 13R, which are juxtaposed to one another and which extend radially from a common axis 14 to define a rather wide dihedral configuration when viewed from the forward end (FIG. 2). While installed wall boards abut mostly as squared corners (90° angles), the formed, but flexible, flat sides of the tool 11 have a normal angle appreciably greater than 90°. An operable range is between 95, and 125, but an optimum angle is thought to exist at about 100°.

The outer side surfaces 13 which contact the wall corners should preferably be of a polished metal (or coated) nature so that in use they will confer on the ceiling plaster and underlying tape a smooth surface and create a feather blend of ceiling tape with the abutting wall.

Figure 4:
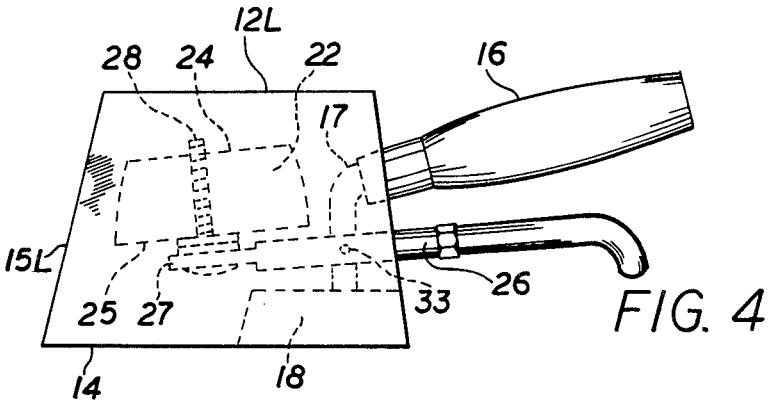
FIG. 4 is a side elevation of the tool shown in FIG. 1.

In FIG. 4, the side view further reveals how the forward edges 15 and 15 of the blade sides, respectively, incline backwardly and uniformly away from the trough 14 (or axis) of the tool body to the upper edges 12L and 12R. This feature serves to aid in spread of ceiling material while the tool is in operation finishing a corner.

Reverting again to FIG. 1, it will be seen that the gripping means, has a handle portion 16 of polished surface, or the like, joined with a rigid elbow-like shaft 17, the vertical leg of which terminates at fixed bracket 18. The latter seats in a fixed manner (by tack welding or the like), along the trough portion of the inner surface 19 of body 12. Grip 16 is usually disposed centrally thereof for achieving balanced application of corner pressure by the installer. The dihedral configuration of the bracket 18 is conformed to that of the inner blade surface 19 to assure durable anchoring to it. The vertical leg of shalft 17 of handle 16 is bored transversely along its intermediate portion to admit a horizontal pin (not seen) which supports, in a pivotal manner, the sides biasing assembly, generally 21.

Figure 6:
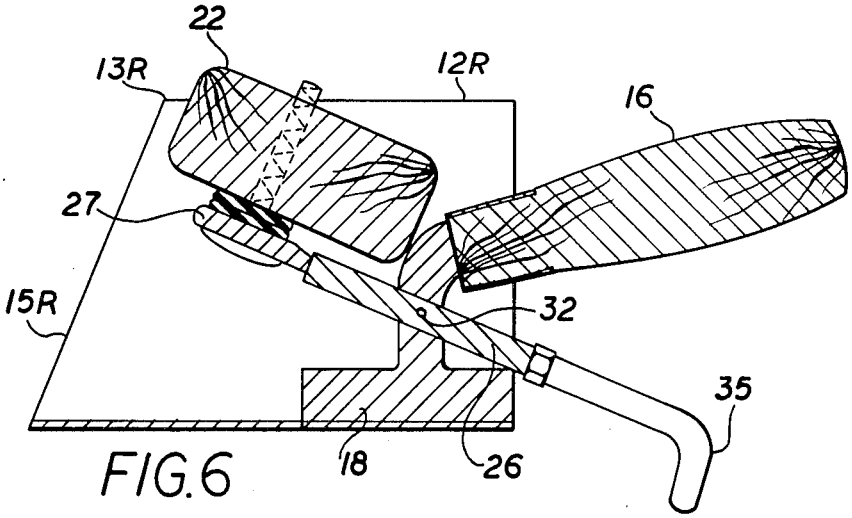
FIG. 6 is a cross-section elevation view taken substantially along the lines of 6—6 in FIG. 5.

It will be further seen from FIG. 2 and 6, that the straddle block 22 makes an interruptable contact with the inner surfaces 19R and 19L of the tool. The horizontal extremities 23R and 23L (FIG. 2) of block 22 are beveled inwardly from their surfaces upper 24 to lower surface 25 as planar surfaces angle to conform substantially to the inner surface 19L and 19R, thereby permitting exertion a uniform pressure throughout the area of the biasing contact. When not in use, block 22 lies loosely cradled within the sides 19R and 19L, while remaining pinned to horizontal support bar 26.

Figure 3:
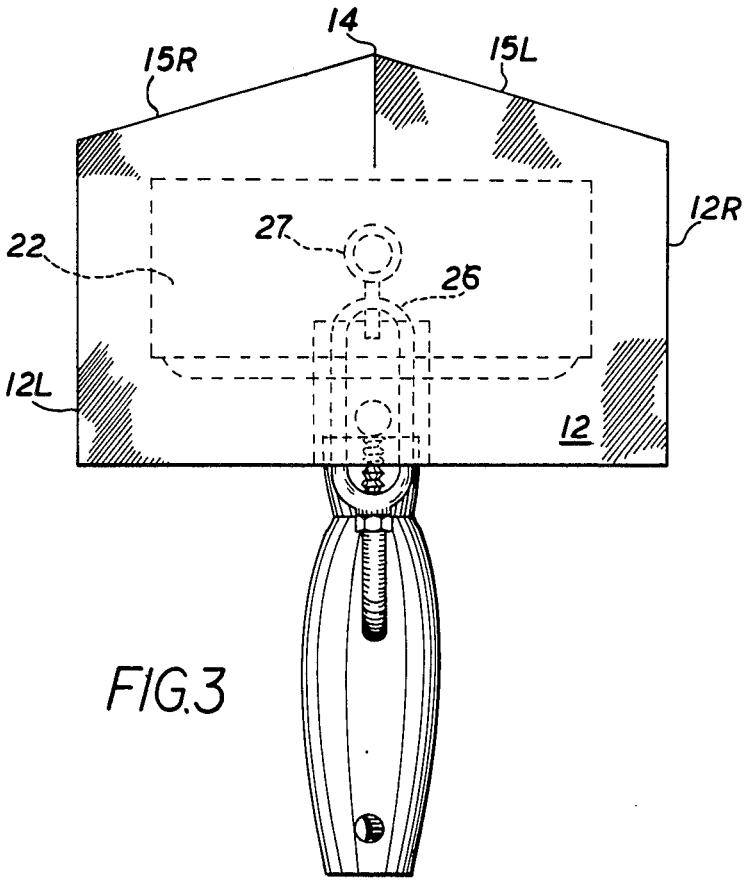
FIG. 3 is a under side elevation view of the tool shown in FIG. 1.
Figure 5:
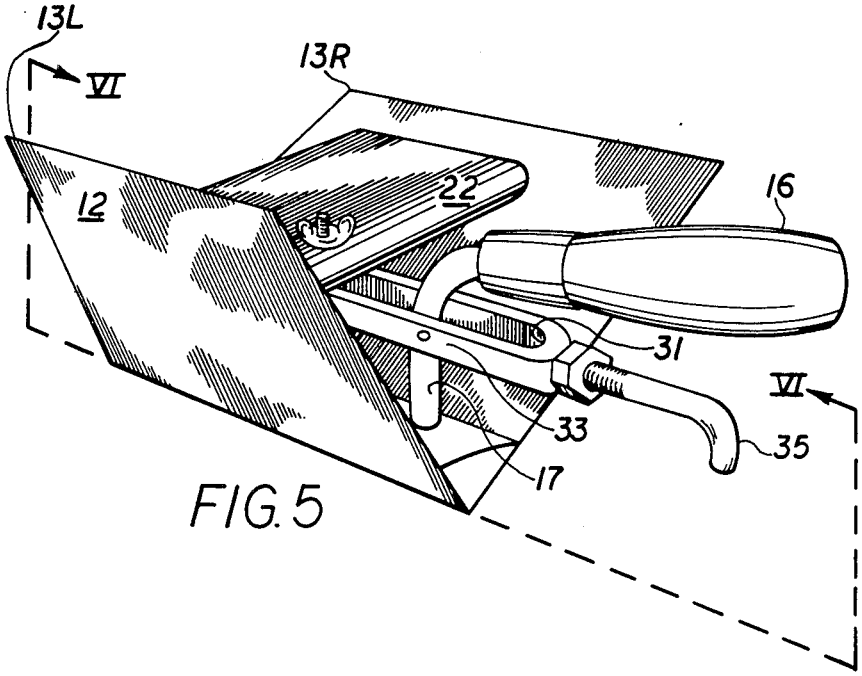
FIG. 5 is a perspective view of the rearward end of the tool showing the sides flexing mechanism.

In FIGS. 3 and 4, the manner of the pinning of the straddle block 22 to support bar 26 is better seen. The forward end of bar 26 is provided with a ring 27 through which a threaded retention bolt 28 is vertically oriented (bolt head downward) and on which a wing nut 29 is turned down to lock bar 22 against ring 27. Optionally, one or more conventional washers, like 31U and 31L, (FIG. 2) can be interposed between the lower ring and the upper wing nut so as to protect the surfaces of the block from marring. A longitudinal slot 31 is also provided within bar 26 (FIG. 5), through which the grip shaft 17 is positioned during tool assembly. Dual bore holes 32 (FIG. 6) traverse the slotted portion of bar 26 (and are aligned with bore hole not seen in shaft 17, which admits of a solid pin 33) thusly, support bar 26 can be pivoted in a limited arc by manipulation of the curved finger grip 35 provided at the rearward end of bar 26 (FIG. 6). At one end of the arc, the lift-off gap of block 22 is limited by the contact of bar 26 against mounting bracket 18. (FIG. 6) At the other end, the block 22 rests against the two upper surfaces, 19R and 19L, and is adapted to exert bias to deflect the sides outwardly as a function of the manual pressure exerted on finger grip 35.

The intermediate position for anchoring shaft 17 within bar slot 31 is predetermined by the overall length of bar 26. The ring end 27 is arranged so that when the block is secured thereon, it will exert a balanced outward bias on the tool surfaces.

In operation, when the tool is pressed against and along a right-angled corner, it is accompanied by slight squeezing pressure on the finger grip 35, so as to bias the tool sides tightly against the converging dry wall boards, this manual effort causes the forward tapered edges of the tool to trowel the sealing plaster of the joint down to a feather edge relationship with the surfaces of the corner panels of the wall structure.

The use of the present tool has effected considerable economy in the construction of so-called dry wall, that is, walls constructed of wall board, in that the joints or seams of the wall board panels may be expeditiously sealing paste filled and trimmed, and also, the inside corner seams can be formed with plaster in a highly expeditious manner, inasmuch as very little is left to the dexterity and skill of the installer other than to exert a sufficient pressure upon the tool to deflect the operating forward ends thereof in the manner hereinbefore described. The joints thus formed, while being substantially uniform, must follow the converging surfaces of the wall panel which form the corner structures and film of plaster which overflows from the immediate joint region onto the panel surfaces, adjacent the corner seams, and will be feather edged relative to the panel surfaces. This will eliminate most of the sanding operation heretofore found necessary before decorative media could be applied to a seamed dry wall structure.

It is to be understood that while it is preferred to provide the tool with a good grade of flexible steel, other flexible material, such as formed plastic blades, may be found satisfactory for the purposes stated.

What is claimed is:

1. A wall board corner finishing tool comprising:

a. A body formed of a manually flexible, planar sheet material having two substantially flat sides juxtaposed and extending radially from one common axis to define a dihedral configuration set at a uniform angle from the edge thereof throughout its length, which angle is measureably greater than 90° but less than 120°;

b. A gripping means affixed essentially centrally of the inner surfaces of the dihedral body and extending rearwardly of the back edge thereof; and c. a tool angle biasing means extending beneath gripping means and pivotally connect therewith and connected to means for biasing outwardly the flat sides of the tool to enlarge the set angle normally defined by said flat sides, so as to allow their divergence relative to each other when the sides are flexed outwardly during use, thereby to aid in smooth blending of the seam sealing materials into the wall board corner.

2. A tool as set forth in claim 1 in which the dihedral angle of the flat sides is not less than 95°.

3. A tool as set forth in claim 1 in which the flat sides are deformable under manual pressure.

4. A tool as set forth in claim 1 in which the flat sides are of a smooth metallic surface.

5. A tool as set forth in claim 1 in which the forward edges of the flat sides are tapered rearwardly from their common axis to their outer edges.

* * * * *